US006983598B2

(12) United States Patent
Dearman

(10) Patent No.: US 6,983,598 B2
(45) Date of Patent: Jan. 10, 2006

(54) ENGINES DRIVEN BY LIQUIFIED OR COMPRESSED GAS

(75) Inventor: Peter Thomas Dearman, Bishop's Stortford (GB)

(73) Assignee: Highview Enterprises Limited, Battle (GB)

( * ) Notice: Subject to any disclaimer, the term of this patent is extended or adjusted under 35 U.S.C. 154(b) by 0 days.

(21) Appl. No.: 10/204,292

(22) PCT Filed: Feb. 15, 2001

(86) PCT No.: PCT/GB01/00619

§ 371 (c)(1),
(2), (4) Date: Dec. 2, 2002

(87) PCT Pub. No.: WO01/63099

PCT Pub. Date: Aug. 30, 2001

(65) Prior Publication Data

US 2003/0136126 A1 Jul. 24, 2003

(30) Foreign Application Priority Data

Feb. 22, 2000 (GB) ..... 0004007

(51) Int. Cl.
*F01K 25/06* (2006.01)

(52) U.S. Cl. ..... 60/649; 60/651; 60/671

(58) Field of Classification Search ..... 60/649, 60/651, 671, 673, 618, 619, 620, 623
See application file for complete search history.

(56) References Cited

U.S. PATENT DOCUMENTS

| | | | | | |
|---|---|---|---|---|---|
| 3,188,833 | A | * | 6/1965 | Robinson | 62/505 |
| 3,451,342 | A | * | 6/1969 | Schwartzman | 417/379 |
| 3,879,949 | A | * | 4/1975 | Hays et al. | 60/649 |
| 3,975,914 | A | * | 8/1976 | Tufts et al. | 60/673 |
| 4,037,415 | A | * | 7/1977 | Christopher et al. | 60/673 |
| 4,143,516 | A | * | 3/1979 | Long | 60/649 |
| 4,504,030 | A | * | 3/1985 | Kniat et al. | 244/57 |
| 4,578,943 | A | * | 4/1986 | Scampini | 60/39.59 |
| 5,027,602 | A | * | 7/1991 | Glen et al. | 60/651 |
| 5,074,110 | A | * | 12/1991 | Singh | 60/39.63 |

FOREIGN PATENT DOCUMENTS

| | | | |
|---|---|---|---|
| DE | 691549 | * | 4/1940 |
| FR | 2273940 | * | 1/1976 |
| FR | 2338377 | * | 8/1977 |

* cited by examiner

*Primary Examiner*—Hoang Nguyen
(74) *Attorney, Agent, or Firm*—Barnes & Thornburg

(57) ABSTRACT

An engine has a chamber (3) accommodating a rotor (5) providing shaft power from the expansion in the chamber (3) of a refrigerated or compressed drive fluid admitted to the chamber (3). A heat-exchange liquid is also admitted to the chamber (3). The heat-exchange liquid gives up heat energy to the expanding drive fluid in the chamber (3), and the cooled heat-exchange fluid is withdrawn from the chamber by a return pipe (16), passed through a heat exchanger (20) to raise its temperature to ambient and then reintroduced into the chamber (3).

16 Claims, 7 Drawing Sheets

ENGINES DRIVEN BY LIQUIFIED OR COMPRESSED GAS

This invention relates to engines driven by liquified or compressed gas.

In a known engine of this type, liquid nitrogen is admitted to an expansion chamber. The nitrogen expands and drives a piston or rotor within the chamber to produce shaft power. The expansion of the nitrogen causes cooling and the cooling effect itself limits the potential for gas expansion. As a result, the efficiency of known engines of this type is low. The invention aims to improve the efficiency of engines driven by liquified or compressed gas.

According to one aspect of the invention an engine comprises an expansion chamber, inlet means for admitting to the chamber a drive fluid, in a refrigerated or compressed condition, and also for admitting to the chamber a heat-exchange liquid, outlet means for withdrawing the heat-exchange liquid, in a cooled state, from the chamber and a heat-exchanger for increasing the temperature of the withdrawn heat-exchange liquid prior to re-circulation of the heat-exchange liquid through the chamber, in use the drive fluid expanding in the chamber and the heat-exchange liquid giving up heat energy to the expanding drive fluid, the expansion of the drive fluid causing the generation of shaft power by the engine.

According to another aspect of the invention there is provided a method of generating shaft power from a drive fluid, in a refrigerated or compressed condition, comprising admitting the drive fluid to an expansion chamber, allowing the drive fluid to expand in the chamber to produce shaft power, wherein a heat-exchange liquid is additionally admitted to the chamber where the heat-exchange liquid gives up heat energy to the expanding drive fluid the cooled heat-exchange liquid being withdrawn from the chamber, heated and re-circulated to the chamber.

Thus, in the invention the heat-exchange liquid provides a source of thermal energy which is drawn upon to reduce the amount of cooling to which the drive fluid is subjected when the drive fluid expands in the chamber. The transfer of heat energy from the heat-exchange liquid to the drive fluid increases the temperature of the expanding drive fluid, thereby increasing its expansion.

The heat-exchange liquid is preferably at or close to ambient temperature when it is supplied to the chamber.

The drive fluid is preferably liquified nitrogen or air or, less preferably, liquified carbon dioxide, or any mixture of these or other gases.

The chamber may accommodate a movable drive member which is moved, with respect to the housing of the chamber, to produce the shaft power. In one embodiment, the drive member is rotatably mounted in the housing so that the engine is a rotary engine. In this case the drive member may carry movable vanes which engage the inner periphery of the housing as the member rotates therein. In another embodiment, the housing is a cylinder and the drive member is a piston reciprocatable within the cylinder, the piston driving a crankshaft to produce the shaft power.

The heat exchanger may have a length of flexible pipe or tube through which the heat-exchange fluid flows, drive means being provided to apply a repetitive flexing movement to the pipe or tube to prevent the accumulation of ice on the external surface of the pipe or tube.

Preferred embodiments of the invention will now be described, by way of example, with reference to the accompanying drawings, in which.

Throughout the drawings, corresponding parts bear the same reference numerals.

Figure 1:
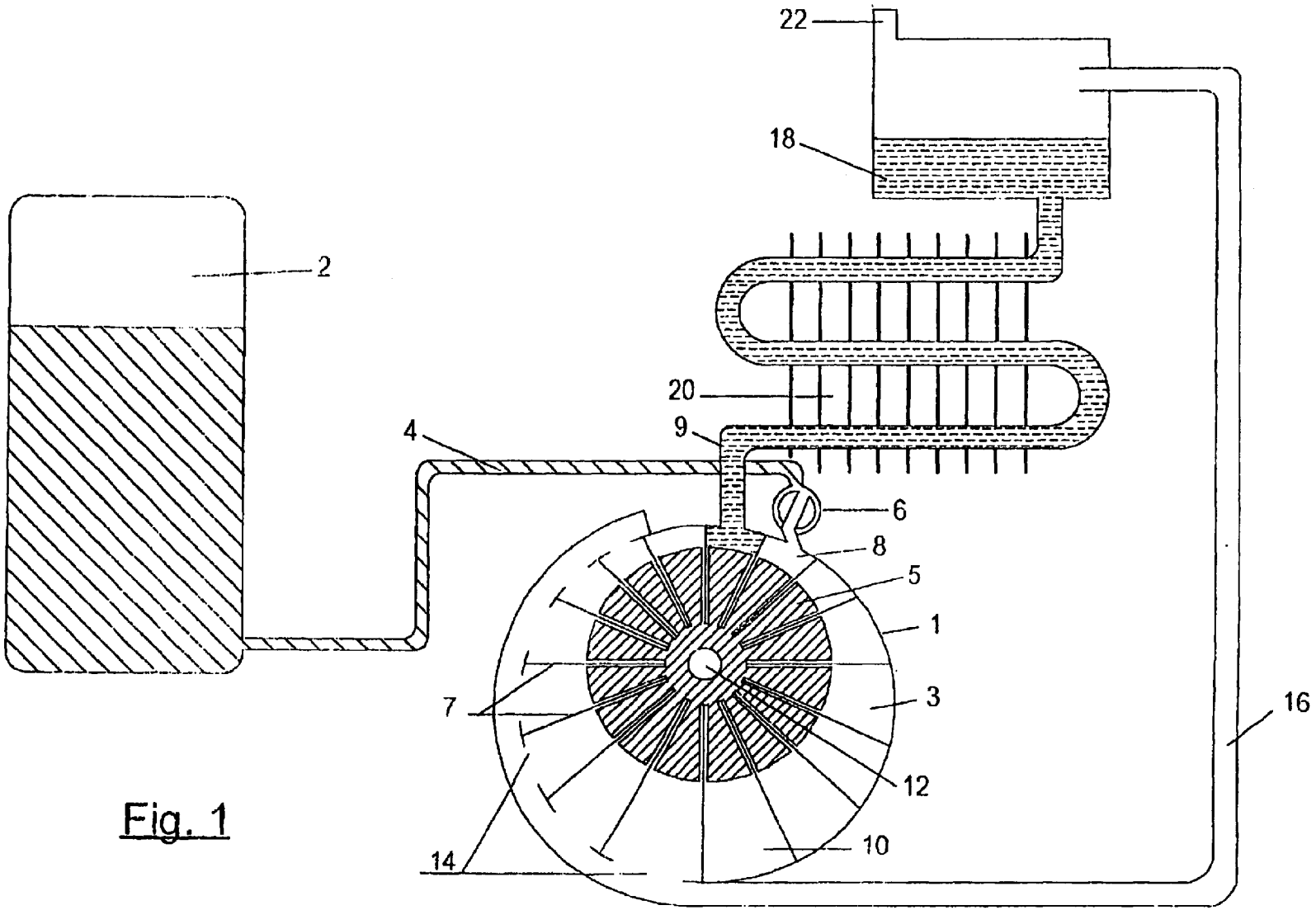
FIG. 1 is a diagrammatic view of a rotary engine according to the invention.

Referring to FIG. 1, the engine has a generally cylindrical housing 1 defining a cylindrical chamber 3 within which is mounted, on an eccentric axis 12, a cylindrical rotor 5 having a plurality of radially extending slots each accommodating a slidable vane 7 the radially outer extremity of which engages the inner periphery of the housing 1 as the rotor 5 rotates within the housing 1.

A pressurised storage tank 2 holds a supply of drive fluid in the form of liquid nitrogen at about −200° C. Liquid nitrogen is fed to the chamber 3 through a supply pipe 4 and a flow control device 6, in this case a rotary valve. First inlet means admit the liquid nitrogen to the chamber 3. A heat-exchange liquid, such as ethylene glycol, is also supplied to the chamber 3 through a second inlet means fed by a supply pipe 9 drawing heat-exchange liquid from a reservoir 18. Heat-exchange liquid is withdrawn from the chamber 3 through a return pipe 16 which returns the heat-exchange liquid to the reservoir 18. In its passage from the reservoir 18 to the chamber 3, the heat-exchange liquid passes through a heat-exchanger 20 provided with a plurality of fins.

In use, liquified nitrogen is admitted to the chamber 3 and expansion takes place between locations 8 and 10, causing the rotor 5 to rotate about its rotational axis 12 in a clockwise direction as viewed in FIG. 1. The expansion of the nitrogen causes cooling but, by recourse to the invention, the expanding nitrogen absorbs heat energy from the heat-exchange liquid which is therefore cooled. The nitrogen, now in an expanded gaseous state, and the cooled heat-exchange liquid, exit through ports 14 and are then returned to the reservoir 18 by means of the return pipe 16. The recirculated heat-exchange liquid absorbs heat from the atmosphere by flowing through the heat-exchanger 20. As a result, the heat-exchange liquid admitted to the chamber 3 is at about ambient temperature. The nitrogen is exhausted or bled off from the reservoir 18 by an outlet 22.

Figure 2:
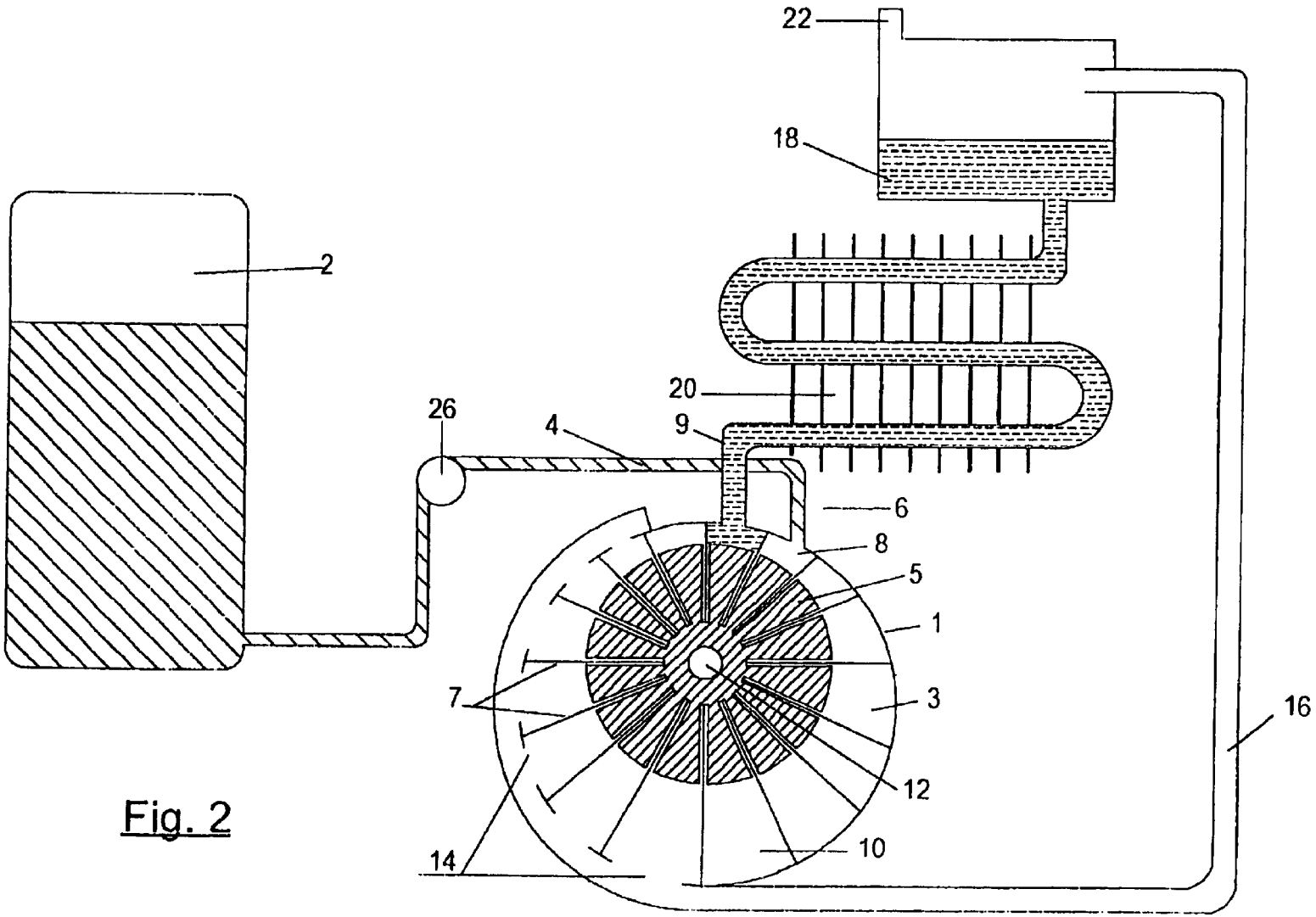
FIGS. 2 and 3 show modifications of the engine shown in FIG. 1.

In the modification of FIG. 2, a pump 26 is incorporated in the pipe 4 supplying liquified nitrogen to the chamber 3. The feed pump can be controlled to vary the flow of liquified nitrogen to the chamber.

Figure 3:
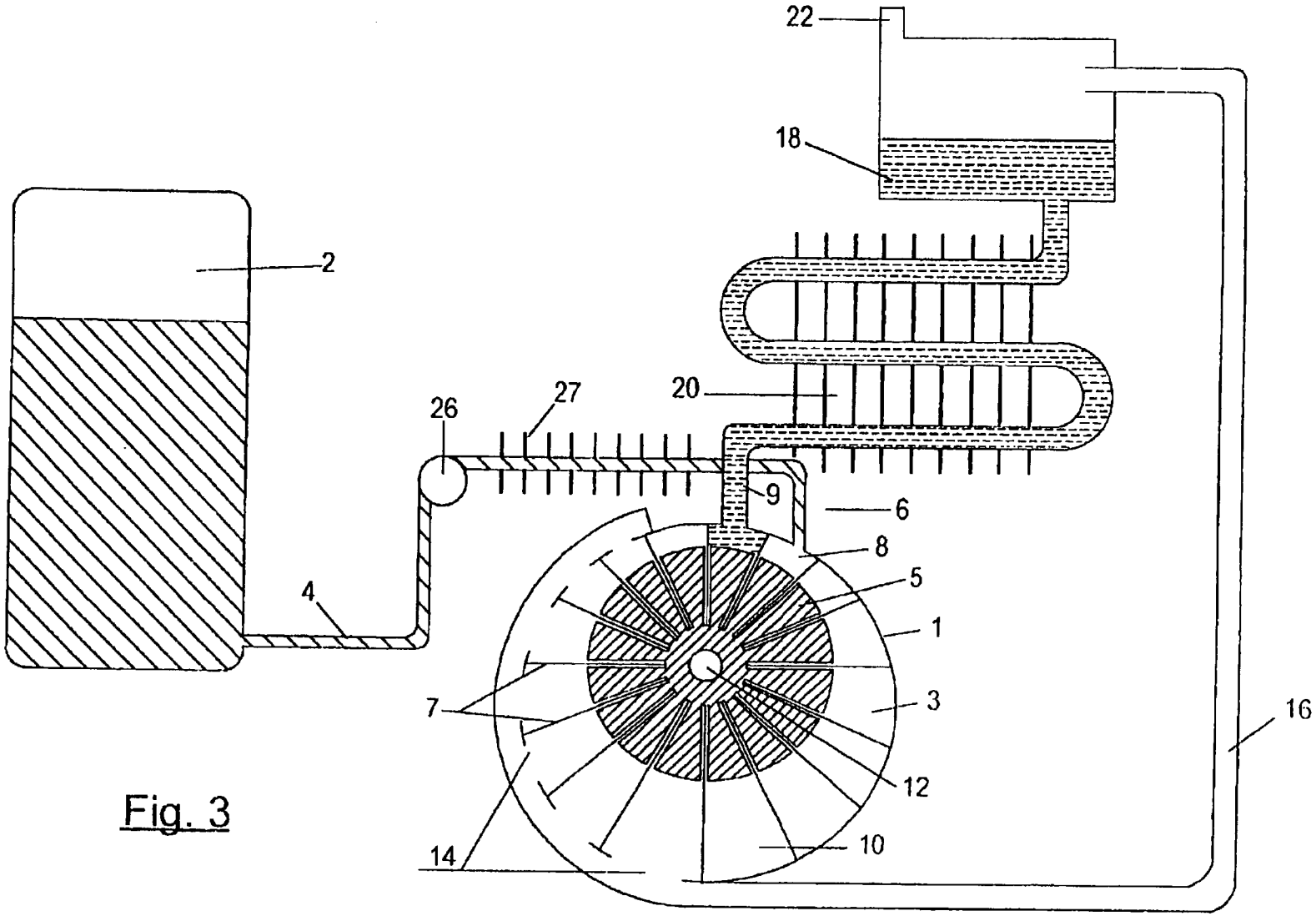

The modification of FIG. 3 is similar to that of FIG. 2 but with the addition of a heat-exchanger 27 disposed between the pump 26 and the inlet means to the chamber 3. The heat-exchanger 27 has a number of fins in order to heat the liquified nitrogen somewhat before admission to the chamber 3. This can reduce icing around the chamber without significant loss of the amount of power produced.

Figure 4:
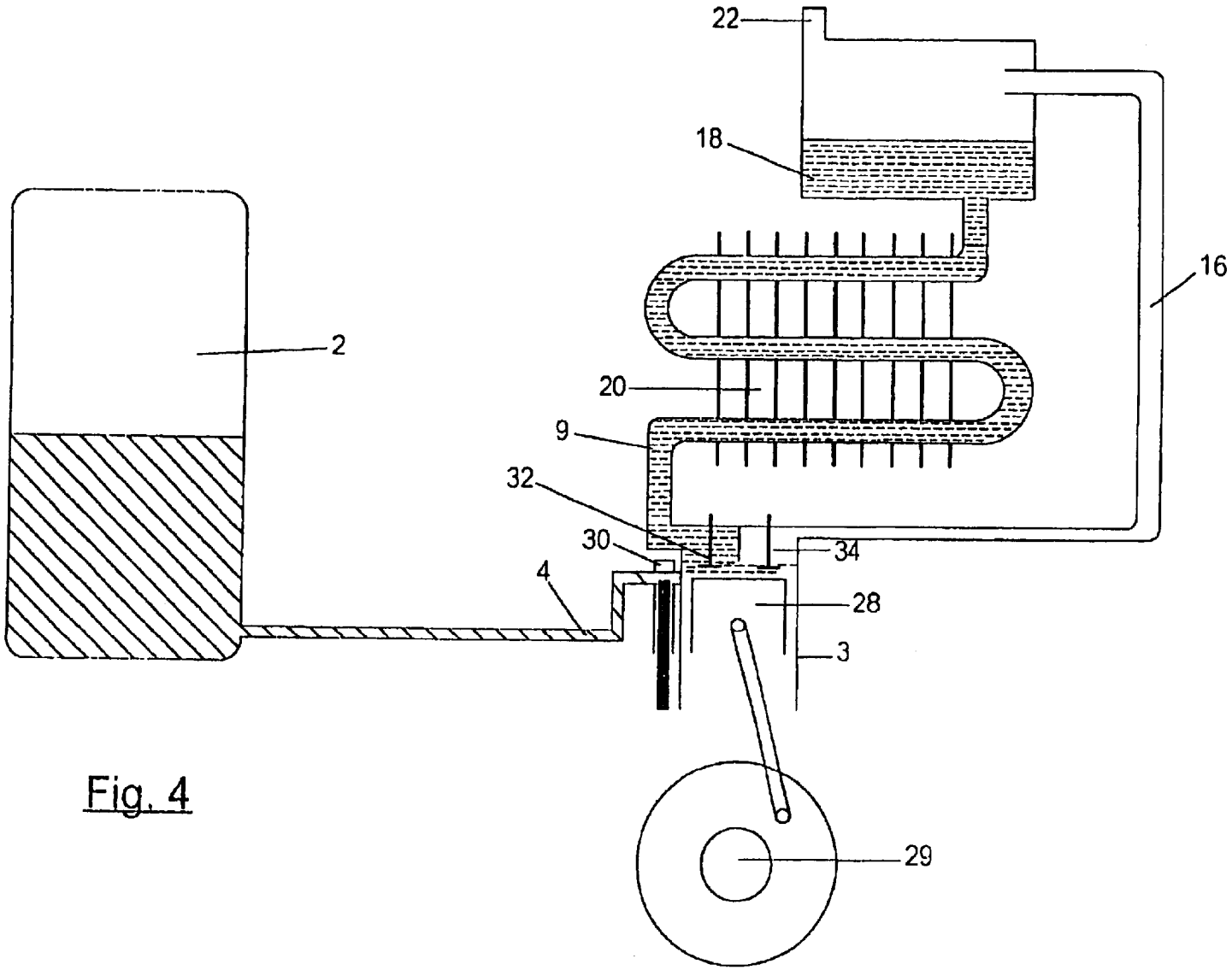
FIG. 4 is a diagrammatic view showing a reciprocating engine according to the invention.

The engine shown in FIG. 4 has an expansion chamber 3 in the form of a cylinder within which a piston 28 is capable of reciprocation, the piston 28 driving a crankshaft 29 which produces the shaft power. The pipe 4 for the liquified nitrogen incorporates a flow control device 30 which may be a timed injection pump which is operative to dispense dosages of liquified nitrogen at appropriate points of the cycle of the engine. For example, during the first part of the cycle heat-exchange liquid is drawn into the cylinder through an inlet valve 32 and at this point liquified nitrogen is also injected into the heat-exchange liquid. The liquified nitrogen expands, the pressure in the cylinder rises and forces the piston 28 to undertake a pressure stroke. When the piston 28 reaches bottom dead centre, an exhaust valve 34 opens and the expanded nitrogen and heat-exchange liquid flow through the valve 34 and thence by the return pipe 16 to the reservoir 18.

In each of the described embodiments, the heat-exchange liquid is drawn into the chamber by a suction effect produced by the rotor or piston. When inside the chamber 3, the heat-exchange liquid is in intimate contact with the nitrogen, so effective heat transfer takes place from the heat-exchange liquid to the expanding nitrogen. This transfer of heat energy to the nitrogen increases the amount by which the nitrogen expands, so increasing the amount of shaft power produced by the engine. The heat-exchange liquid is recirculated through the chamber 3, passing through the heat-exchanger 20 in order to return its temperature to ambient.

Figure 5:
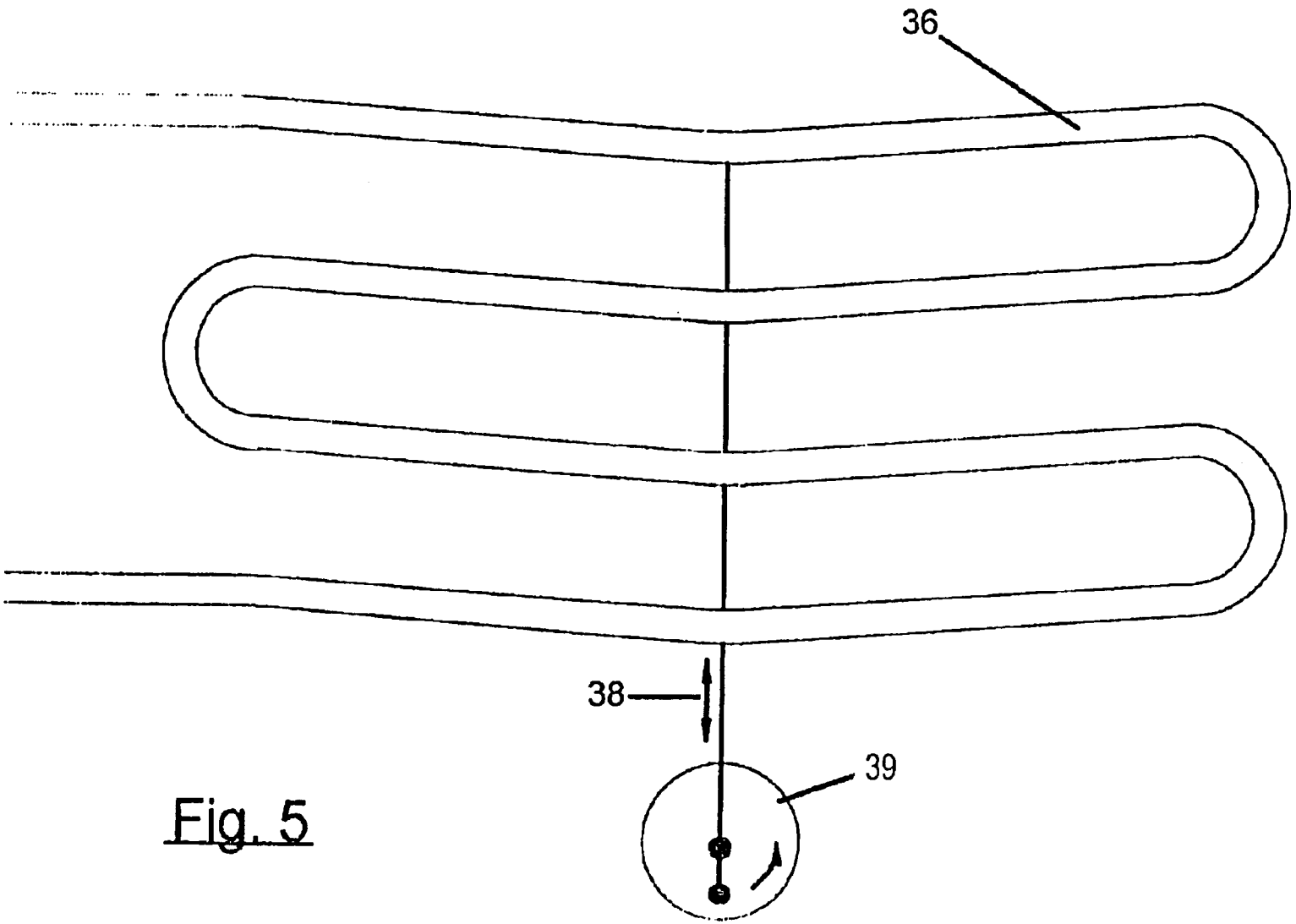
FIG. 5 illustrates a part of a heat-exchanger usable in the engine of any of the illustrated embodiments.

FIG. 5 illustrates how the heat-exchanger 20 may include a serpentine length of flexible rubber pipe 36 through which the heat-exchange liquid flows. Any water vapour in the air which freezes on the pipe 36 is dislodged by applying a reciprocating motion to the pipe 36, as indicated by arrow 38. This repeated flexing of the pipe is applied by the drive means 39 and causes the ice to break and fall away from the pipe surface.

Figure 6:
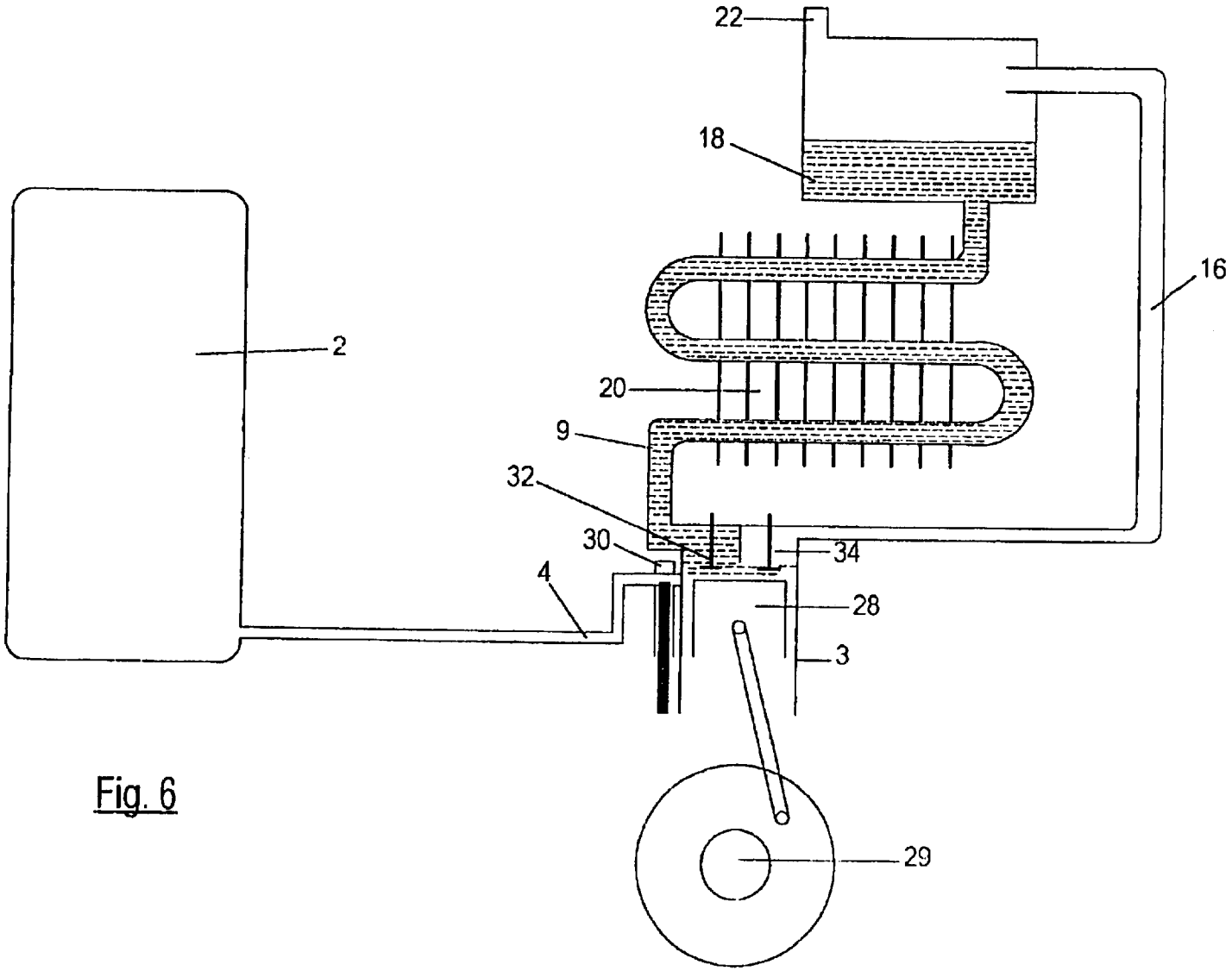
FIGS. 6 and 7 show engines similar to those of FIGS. 4 and 1 respectively, but driven by compressed gas.
Figure 7:
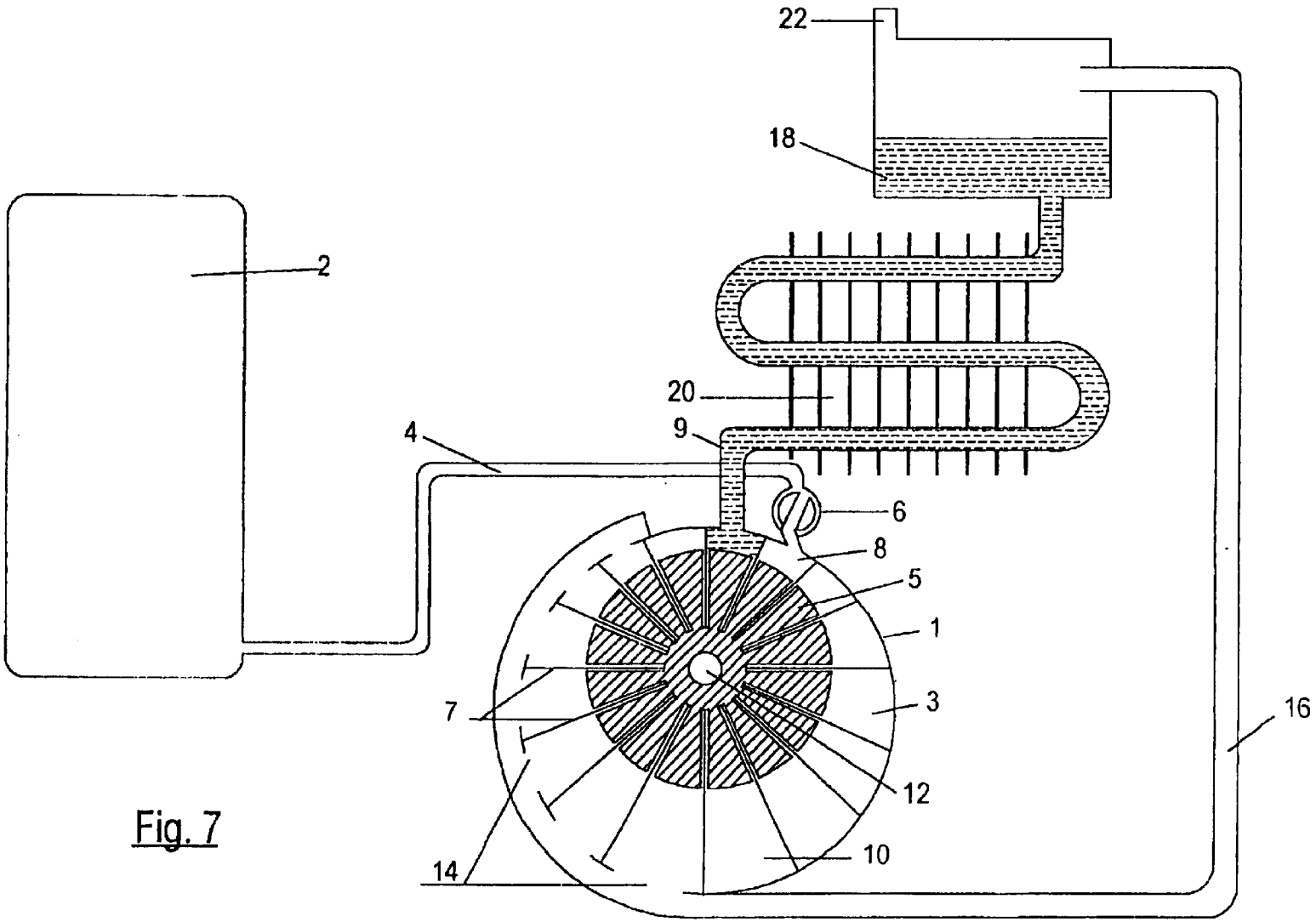

The engine shown in FIG. 6 is similar to that shown in FIG. 4, except that the tank 2 is in the form of a compressed gas cylinder holding a compressed gas such as nitrogen. The engine shown in FIG. 7 is also driven by a compressed gas such as nitrogen in a cylinder 2, the engine being a rotary engine corresponding to that illustrated in FIG. 1.

What is claimed is:

1. An engine comprising an expansion chamber, the chamber accommodating a drive member movable within a housing, the drive member being movable with respect to the housing to produce shaft power, the engine further comprising inlet means for admitting to the chamber a drive fluid, comprising a refrigerated liquified gas, and also for admitting to the chamber a heat-exchange liquid, outlet means for withdrawing the heat-exchange liquid, in a cooled state, from the chamber and a heat exchanger for increasing the temperature of the withdrawn heat-exchange liquid prior to re-circulation of the heat-exchange liquid through the chamber, in use the drive fluid expanding in the chamber and the heat-exchange liquid giving up heat energy to the expanding to a gaseous state drive fluid, the expansion of the drive fluid, in the expansion chamber, causing the generation of shaft power by the engine.

2. An engine according to claim 1, wherein the drive fluid is liquified nitrogen, liquified air, liquified carbon dioxide or a mixture thereof.

3. An engine according to claim 1, wherein the drive member is rotatably mounted in the housing.

4. An engine according to claim 3, wherein the drive member carries vanes which engage the inner periphery of the housing as the member rotates.

5. An engine according to claim 1, wherein the drive member is a piston and the housing is a cylinder within which the piston is reciprocatable, the piston driving a crankshaft to produce the shaft power.

6. An engine according to claims 1, wherein the heat exchanger has a length of flexible pipe or tube through which the heat-exchange fluid flows, drive means being provided to apply a repetitive flexing movement to the pipe or tube to prevent the accumulation of ice on the external surface of the pipe or tube.

7. A method of generating shaft power from a drive fluid, comprising a refrigerated liquified gas, the method comprising admitting the drive fluid to an expansion chamber, allowing the drive fluid to expand in the chamber to produce shaft power, wherein a heat-exchange liquid is additionally admitted to the chamber where the heat-exchange liquid gives up heat energy to the expanding drive fluid, the cooled heat-exchange liquid being withdrawn from the chamber, heated and re-circulated to the chamber.

8. A method according to claim 7, wherein the heat-exchange liquid is at or close to ambient temperature when it is supplied to the chamber.

9. A method according to claim 7, wherein the drive fluid is admitted to the chamber in a liquid state and expands to a gaseous state in the chamber.

10. A method according to claim 9, wherein the drive fluid is a liquified gas or a liquified mixture of gases.

11. A method according to claim 10, wherein the gas is nitrogen or carbon dioxide, and the mixture of gases is air.

12. A method according to claim 7, wherein the drive fluid is a compressed gas or mixture of gases.

13. A method according to claim 12, wherein the gas is nitrogen, or the mixture of gases is air.

14. An engine according to claim 1, in which said shaft power is caused by the expansion of the drive fluid against the drive member.

15. An engine according to claim 1, in which the inlet means is operable to admit the heat exchange liquid to the chamber prior to the introduction of the liquefied, refrigerated gas.

16. A method according to claim 7 in which the heat exchange liquid is admitted to the chamber prior to the drive fluid.

* * * * *